US007863806B2

(12) United States Patent
Wei et al.

(10) Patent No.: US 7,863,806 B2
(45) Date of Patent: Jan. 4, 2011

(54) COLOR FIELD EMISSION DISPLAY HAVING CARBON NANOTUBES

(75) Inventors: Yang Wei, Beijing (CN); Liang Liu, Beijing (CN); Shou-Shan Fan, Beijing (CN)

(73) Assignees: Tsinghua University, Beijing (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 261 days.

(21) Appl. No.: 12/069,300

(22) Filed: Feb. 8, 2008

(65) Prior Publication Data

US 2009/0134772 A1 May 28, 2009

(30) Foreign Application Priority Data

Nov. 23, 2007 (CN) ..... 2007 1 0124774

(51) Int. Cl.
*H01J 1/62* (2006.01)
*H05B 37/00* (2006.01)
*H01J 63/04* (2006.01)

(52) U.S. Cl. ..... 313/495; 313/309; 313/311; 313/497; 315/160

(58) Field of Classification Search ..... 313/495–498
See application file for complete search history.

(56) References Cited

U.S. PATENT DOCUMENTS 4,818,914 A 4/1989 Brodie
6,794,814 B2 * 9/2004 You et al. ..... 313/496
7,064,474 B2 6/2006 Iiu et al.
2003/0090190 A1 * 5/2003 Takai et al. ..... 313/311
2003/0102222 A1 * 6/2003 Zhou et al. ..... 205/109
2003/0143356 A1 7/2003 Morikawa
2005/0035701 A1 2/2005 Choi et al.
2005/0046335 A1 3/2005 Chen et al.
2005/0236961 A1 10/2005 Wei et al.
2006/0066216 A1 * 3/2006 Koga et al. ..... 313/496
2006/0132048 A1 * 6/2006 Popovich ..... 315/160
2007/0096075 A1 5/2007 Li et al.
2007/0251815 A1 * 11/2007 Lo et al. ..... 204/192.15

FOREIGN PATENT DOCUMENTS

| | | |
|---|---|---|
| CN | 1420518 | 5/2003 |
| CN | 1691267 | 11/2005 |
| CN | 1282211 | 10/2006 |
| JP | 2007115570 | 5/2007 |
| TW | I260669 | 8/2006 |
| TW | I278887 | 4/2007 |
| TW | I281183 | 5/2007 |

* cited by examiner

*Primary Examiner*—Sikha Roy
*Assistant Examiner*—Tracie Green
(74) *Attorney, Agent, or Firm*—Jeffrey T. Knapp

(57) ABSTRACT

A color field emission display includes a sealed container having a light permeable portion and at least one color element enclosed in the sealed container. The color element includes a cathode, at least two anodes, at least two phosphor layers and at least two CNT strings. The phosphor layers are formed on the end surfaces of the anode. The CNT strings are electrically connected to and in contact with the cathode with the emission portion thereof suspending. The phosphor layers are opposite to the light permeable portion, and one emission portion is corresponding to one phosphor layer. The luminance of the color FED is enhanced at a relatively low voltage.

20 Claims, 5 Drawing Sheets

COLOR FIELD EMISSION DISPLAY HAVING CARBON NANOTUBES

RELATED APPLICATIONS

This application is related to commonly-assigned, co-pending application: U.S. patent application Ser. No. 12/069,299, entitled "PIXEL TUBE FOR FIELD EMISSION DISPLAY", filed on May 7, 2009 and U.S. patent application Ser. No. 12/069,313, entitled "COLOR FED FOR FIELD EMISSION DISPLAY", filed on May 28, 2009. The disclosure of the respective above-identified application is incorporated herein by reference.

BACKGROUND

1. Field of the Invention

The invention relates to color field emission displays and, particularly, to a color field emission display having carbon nanotubes.

2. Discussion of Related Art

Field emission displays (FEDs) are based on emission of electrons in vacuum. Electrons are emitted from micron-sized tips in a strong electric field, and the electrons are accelerated and collide with a fluorescent material, and then the fluorescent material emits visible light. FEDs are thin, light weight, and provide high levels of brightness.

Carbon nanotubes (CNTs) produced by means of arc discharge between graphite rods were first discovered and reported in an article by Sumio Iijima, entitled "Helical Microtubules of Graphitic Carbon" (Nature, Vol. 354, Nov. 7, 1991, pp. 56-58). CNTs also feature extremely high electrical conductivity, very small diameters (much less than 100 nanometers), large aspect ratios (i.e. length/diameter ratios) (greater than 1000), and a tip-surface area near the theoretical limit (the smaller the tip-surface area, the more concentrated the electric field, and the greater the field enhancement factor). These features tend to make CNTs ideal candidates for electron emitter in FED. Generally, a color FED of the FED includes a number of CNTs acting as electron emitters. However, single CNT is so tiny in size and then the controllability of the method manufacturing is less than desired. Further, the luminous efficiency of the FED is low due to the shield effect caused by the adjacent CNTs.

What is needed, therefore, is a color FED, which has high luminous efficiency and can be easily manufactured.

SUMMARY

A color field emission display includes a sealed container having a light permeable portion and at least one color element enclosed in the sealed container. The color element includes a cathode, at least two anodes, at least two phosphor layers and at least two CNT strings. The phosphor layers are formed on the end surfaces of the anode. The CNT strings are electrically connected to and in contact with the cathode with the emission portion thereof suspending. The phosphor layers are opposite to the light permeable portion, and one emission portion is corresponding to one phosphor layer. In each CNT string, some of CNT bundles are taller than and project over the adjacent CNT bundles, and each of projecting CNT bundles functions as an electron emitter.

Compared with the conventional color FED, the present color FED has the following advantages: using CNT string as the electron emitter, and thus the color FED is more easily fabricated. Further, the emission portion of the CNT string is in a tooth-shape structure, which can prevent from the shield effect caused by the adjacent CNT bundles, and the turn-on voltage of the color FED is reduced.

Other advantages and novel features of the present color FED will become more apparent from the following detailed description of preferred embodiments when taken in conjunction with the accompanying drawings.

BRIEF DESCRIPTION OF THE DRAWINGS

Many aspects of the present color FED can be better understood with reference to the following drawings. The components in the drawings are not necessarily to scale, the emphasis instead being placed upon clearly illustrating the principles of the present color FED.

Figure 1:
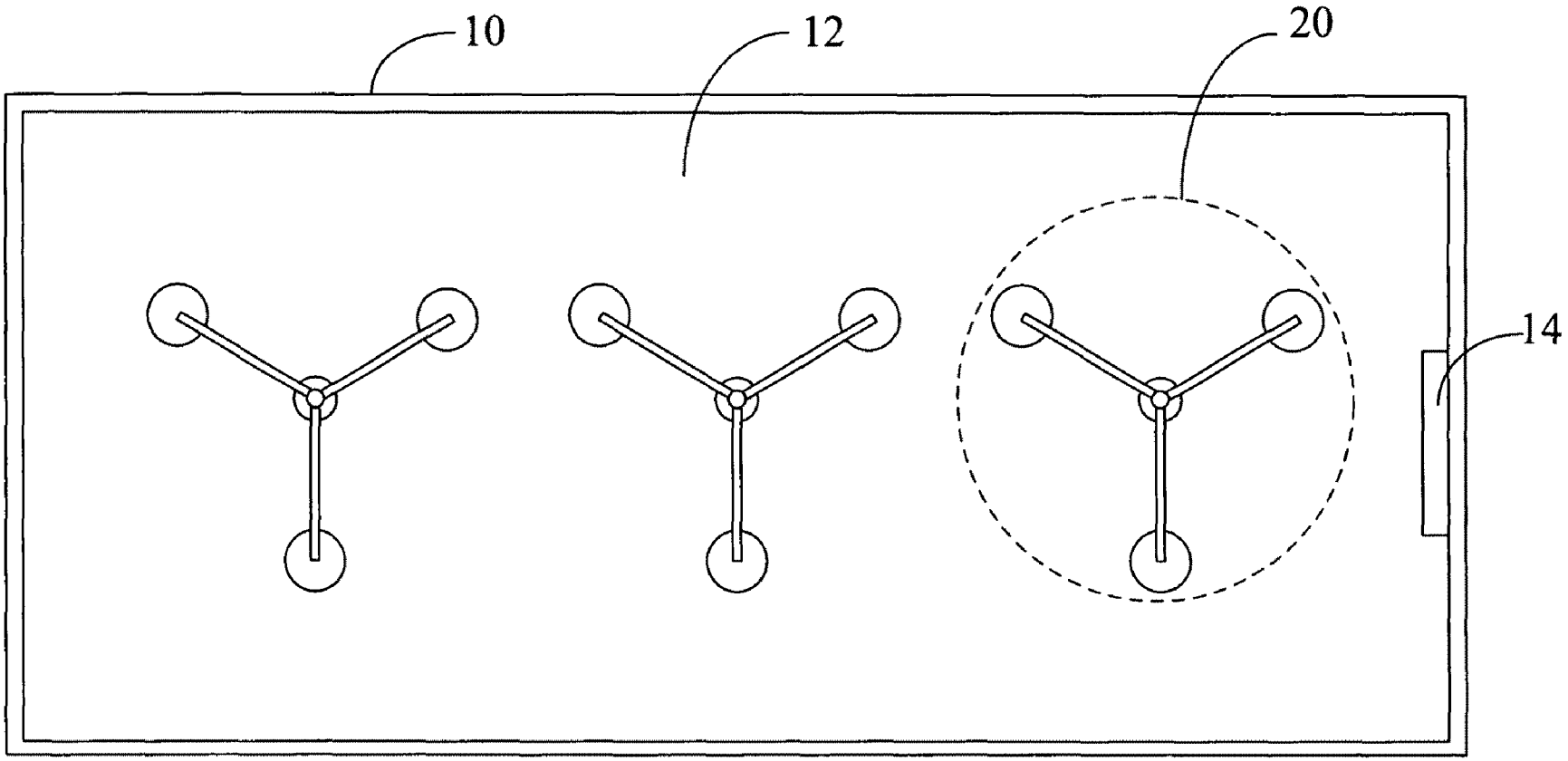
FIG. 1 is a schematic, top-sectional view of a color FED according to an embodiment.

Corresponding reference characters indicate corresponding parts throughout the several views. The exemplifications set out herein illustrate at least one preferred embodiment of the color FED, in one form, and such exemplifications are not to be construed as limiting the scope of the invention in any manner.

DETAILED DESCRIPTION OF PREFERRED EMBODIMENTS

Reference will now be made to the drawings to describe the preferred embodiments of the present color FED having carbon nanotubes, in detail.

Figure 2:
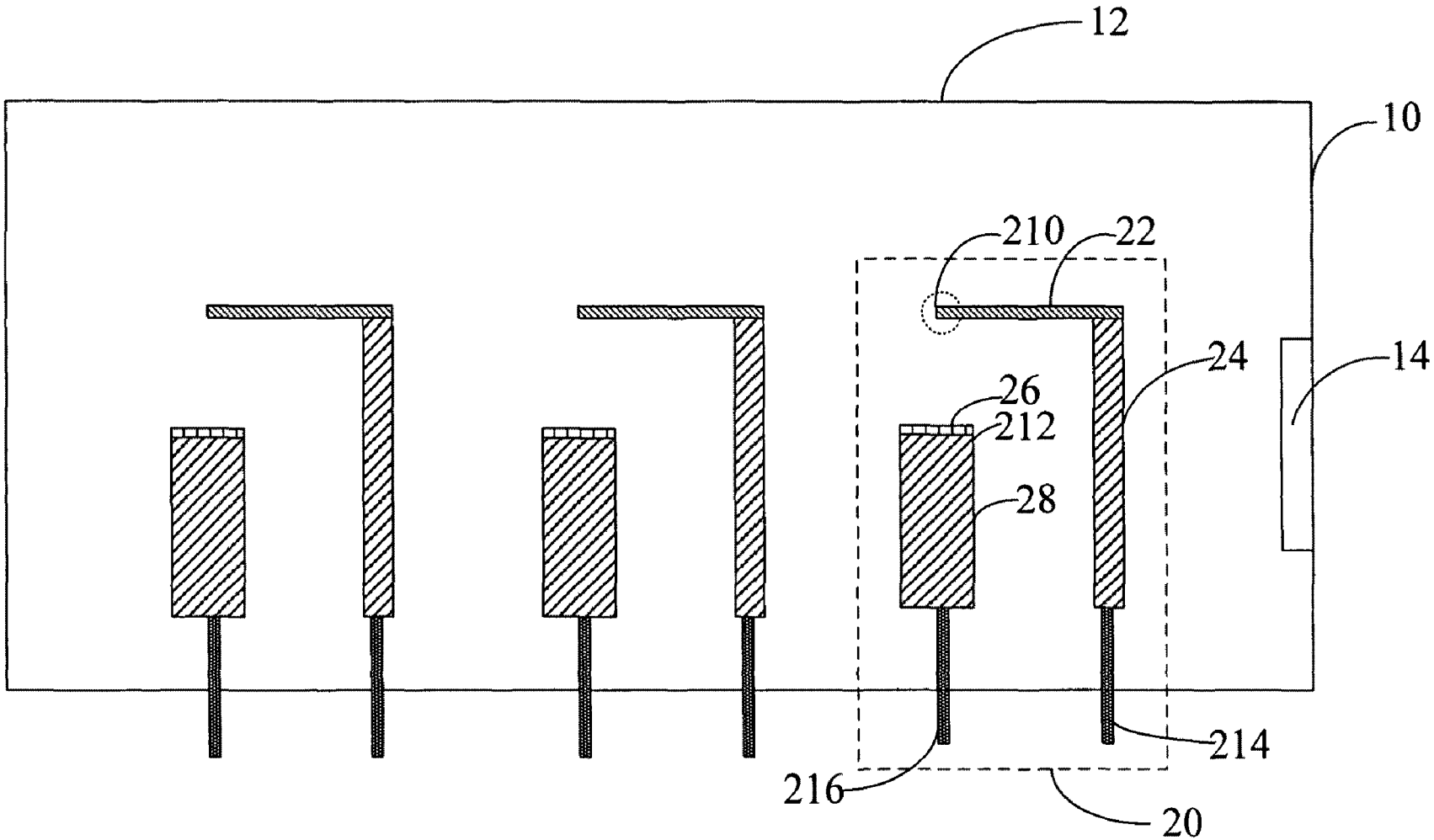
FIG. 2 is a schematic, cross-sectional view of a color FED according to an embodiment.

Referring to FIGS. 1 and 2, a color FED 100 includes a sealed container 10 having a light permeable portion 12, and at least one color element 20 enclosed in the sealed container 10. The sealed container 10 is a hollow member that defines an inner space in vacuum. The cross section of the sealed container 10 has a shape selected from a group consisting of circular, ellipsoid, quadrangular, triangular, polygonal and so on. The sealed container 10 may be comprised of any non-metallic material, and the emission portion 12 need be made of a transparent material. In the present embodiment, the sealed container 10 is a hollow cylinder and comprised of quartz or glass. A diameter of the sealed container 10 is about 2-10 millimeters (mm), and a height thereof is about 5-50 mm. The light permeable portion 12 has a surface selected from the group consisting of a plane surface, a spherical surface and an aspherical surface. Due to at least one color element 20 being sealed into one sealed container 10, the method for manufacturing the color FED 100 is simple and convenient, and the luminescence efficiency thereof is improved.

Each color element 20 includes a cathode 24, three anodes 28, three phosphor layers 26 and three CNT strings 22. The distances between the cathode 24 and the anodes 28 are substantially equal, and are about 0.1-10 millimeters (mm). The spaces among the adjacent anodes 28 are beneficially equal. The cathode 24 is electrically connected to a cathode terminal 214, and each of the anodes 28 is electrically connected to a corresponding anode terminal 216. The cathode terminal 214, and the anode terminal 216 run from the inside to the outside of the sealed container 10, and are supplied with the power source. By adjusting the voltages applied to the anode terminals 216, the color FED 100 can emit any kinds of color light beam, such as white, yellow. The cathode 24, the anodes 28, the cathode terminal 214 and the anode terminals 216 are made of thermally and electrically conductive materials.

In each color element 20, the anodes 28, the phosphor layers 26 and the CNT strings 22 have the same structures, and thus the cathode 24, the anode 28, the phosphor layer 26 and the CNT string 22 are described in the following as an example. Referring to FIG. 2, the phosphor layer 26 with a thickness of about 5-50 microns (μm) is formed on a end surface 212 of the anode 28. The phosphor layer 26 may be a white phosphor layer, or a color phosphor layer, such as red, green or blue. The end surface 212 is a polished metal surface or a plated metal surface, and thus can reflect the light beams emitted from the phosphor layer 26 to the permeable portion 12 to enhance the brightness of the color FED 100.

The CNT string 22 is electrically connected to and in contact with the cathode 24 by a conductive paste, such as silver paste, with an emission portion 210 of the CNT string 22 suspending. The phosphor layer 26 is opposite to the light permeable portion 12, and the emission portion 210 is corresponding to the phosphor layer 26. A distance between the emission portion 210 and the phosphor layer 26 is less than 5 mm. The emission portion 210 can be arranged perpendicular to the phosphor layer 26, parallel to phosphor layer 26 or inclined to phosphor layer 26 with a certain angle. In the present embodiment, the emission portion 210 is parallel to phosphor layer 26, and arranged between the phosphor layer 26 and the light permeable portion 12. The cathode 24 is made of an electrically conductive material, such as nickel, copper, tungsten, gold, molybdenum or platinum.

The CNT string 22 is composed of a number of closely packed CNT bundles, and each of the CNT bundles includes a number of CNTs, which are substantially parallel to each other and are joined by van der Waals attractive force. A diameter of the CNT string 22 is in an approximate range from 1 to 100 microns (μm), and a length thereof is in an approximate range from 0.1-10 centimeters (cm).

Figure 3:
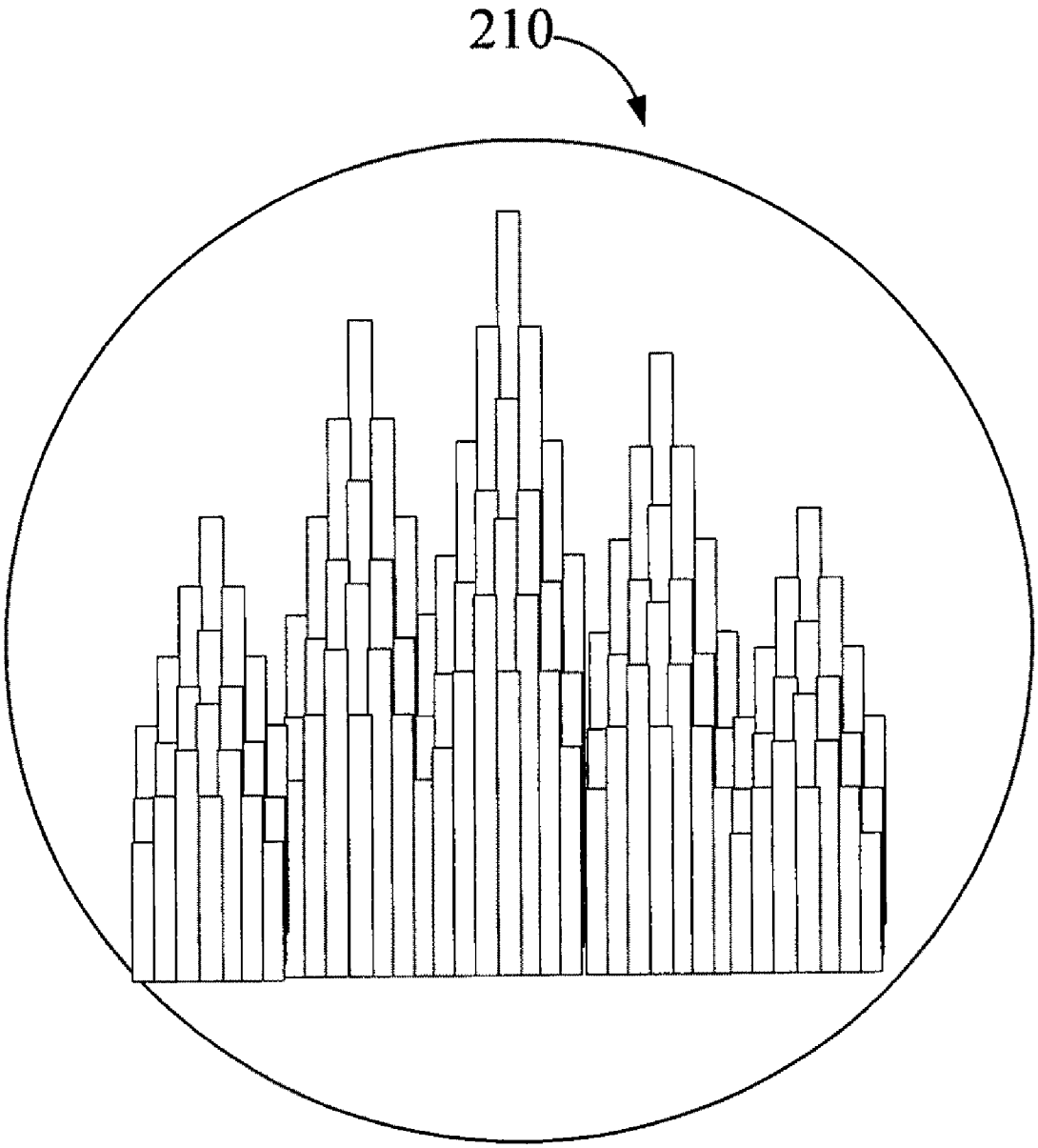
FIG. 3 is a schematic, amplificatory view of part 210 in FIG. 2.
Figure 4:
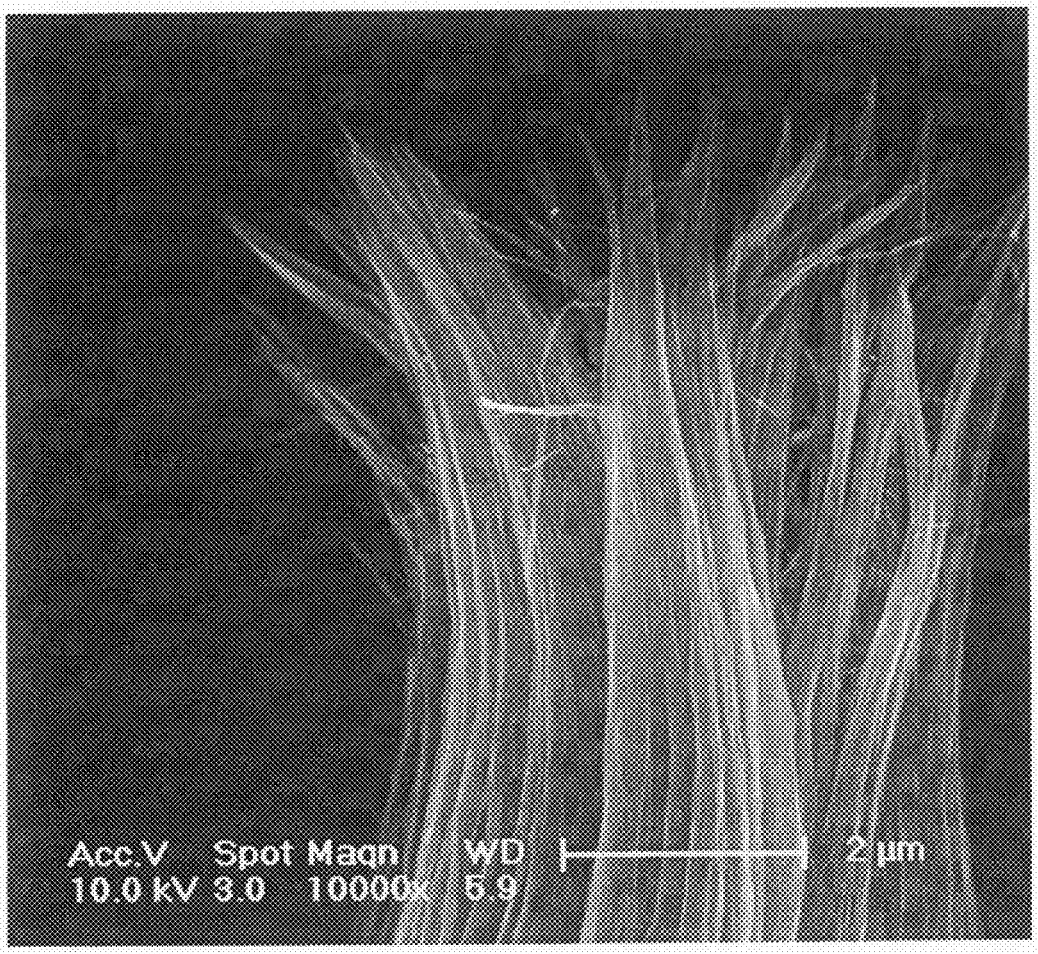
FIG. 4 is a Scanning Electron Microscope (SEM) image, showing part 210 in FIG. 2.
Figure 5:
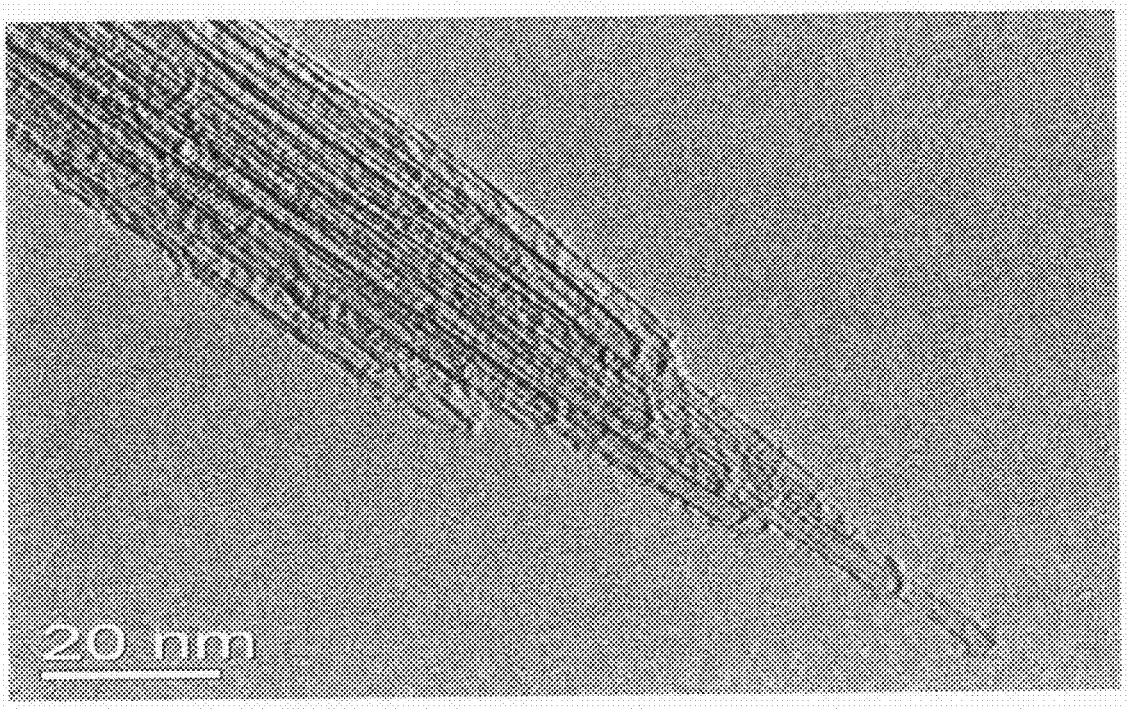
FIG. 5 is a Transmission Electron Microscope (TEM) image, showing part 210 in FIG. 2.

Referring to FIGS. 3, 4 and 5, the CNTs at the emission portion 210 form a tooth-shaped structure, i.e., some of CNT bundles being taller than and projecting above the adjacent CNT bundles. Therefore, a shield effect caused by the adjacent CNTs can be reduced. The voltage applied to the CNT string 22 for emitting electrons is reduced. The CNTs at the emission portion 210 have smaller diameter and fewer number of graphite layer, typically, less than 5 nanometer (nm) in diameter and about 2-3 in wall. However, the CNTs in the CNT string 22 other than the emission portion 210 are about 15 nm in diameter and more than 5 in wall.

A method for making the CNT string 22 is taught in U.S. Application No. US16663 entitled "METHOD FOR MANUFACTURING FIELD EMISSION ELECTRON SOURCE HAVING CARBON NANOTUBES", which is incorporated herein by reference. The CNT string 22 can be drawing a bundle of CNTs from a super-aligned CNT array to be held together by van der Waals force interactions. Then, the CNT string 22 is soaked in an ethanol solvent, and thermally treated by supplying a current thereto. After the above processes, the CNT string 22 has improved electrical conducting and mechanical strength.

In operation, a voltage is applied between the cathode 24 and the anode 28 through the cathode terminal 214 and the anode terminal 216, an electric field is formed therebetween, and electrons are emanated from the emission portion 210 of the CNT string 22. The electrons transmit toward the anode 28, hit the phosphor layer 26, and the visible light beams are emitted from the phosphor layer 26. One part of the light beams transmits through the light permeable portion 12, another part is reflected by the end surface 212 and then transmits out of the light permeable portion 12. Using the CNT string 22, the luminance of the color FED 100 is enhanced at a relatively low voltage.

The color FED 100 may further includes a getter 14 configured for absorbing residual gas inside the sealed container 10 and maintaining the vacuum in the inner space of the sealed container 10. More preferably, the getter 14 is arranged on an inner surface of the sealed container 10. The getter 14 may be an evaporable getter introduced using high frequency heating. The getter 14 also can be a non-evaporable getter.

The color FED 100 may further includes an air vent (not shown). The air vent can be connected with a gas removal system such as, for example, a vacuum pump for creating a vacuum inside the sealed container. The color FED 100 is evacuated to obtain the vacuum by the gas removal system through the air vent, and then sealed.

Finally, it is to be understood that the above-described embodiments are intended to illustrate rather than limit the invention. Variations may be made to the embodiments without departing from the spirit of the invention as claimed. The above-described embodiments illustrate the scope of the invention but do not restrict the scope of the invention.

What is claimed is:

1. A color field emission display comprising:

a sealed container comprising a light permeable portion having a light permeable surface;

a plurality of color elements enclosed in the sealed container, and each of the plurality of color elements comprising:

a single cathode;

at least two anodes spaced from the light permeable portion;

at least two phosphor layers, wherein each of the at least two phosphor layers is formed on an end surface of one of the at least two anodes and has a luminescence surface opposite to the light permeable surface; and at least two carbon nanotube strings electrically connected to the single cathode, wherein each of the at least two carbon nanotube strings extends from the single cathode to one of the at least two phosphor layers and has an emission portion suspended above the luminescence surface and located between the luminescence surface and the light permeable surface.

2. The color field emission display as claimed in claim 1, wherein a diameter of each of the at least two carbon nanotube strings is in an approximate range from 1 micrometer to 100 micrometers, and a length of each of the at least two carbon nanotube strings is in an approximate range from 0.1 centimeters to 10 centimeters.

3. The color field emission display as claimed in claim 1, wherein each of the at least two carbon nanotube strings comprises a plurality of closely packed carbon nanotube bundles.

4. The color field emission display as claimed in claim 3, wherein the emission portion comprises a plurality of first carbon nanotube bundles and a plurality of second carbon nanotube bundles, and the plurality of first carbon nanotube bundles is taller than and projects over the plurality of second carbon nanotube bundles and functions as an electron emitter.

5. The color field emission display as claimed in claim 4, wherein each of the plurality of first carbon nanotube bundles comprises a plurality of carbon nanotubes substantially parallel to each other and joined by van der Waals attractive force.

6. The color field emission display as claimed in claim 5, wherein a single carbon nanotube of the plurality of carbon nanotubes is taller than and projects over adjacent carbon nanotubes.

7. The color field emission display as claimed in claim 4, wherein a diameter of each of the plurality of carbon nanotubes is less than 5 nanometers, and a number of graphite layers of each of the plurality of carbon nanotubes is about 2 to 3.

8. The color field emission display as claimed in claim 1, wherein the at least two carbon nanotube strings are in contact with the single cathode through a conductive paste.

9. The color field emission display as claimed in claim 1, wherein the emission portion is arranged perpendicular to the luminescence surface, parallel to the luminescence surface or inclined to the luminescence surface at a certain angle.

10. The color field emission display as claimed in claim 1, wherein each of the at least two anodes is a respective post, and the single cathode is an additional post; and the at least two anodes and the single cathode are parallel to each other.

11. The color field emission display as claimed in claim 10, wherein the end surface is a polished metal surface.

12. The color field emission display as claimed in claim 1, wherein each of the plurality of color elements further comprises at least two anode terminals electrically connected to the at least two anodes and a single cathode terminal electrically connected to the single cathode; and the at least two anode terminals and the single cathode terminal run from an inside to an outside of the sealed container.

13. A color field emission display comprising:

a sealed container comprising a light permeable portion having a light permeable surface;

a plurality of color elements enclosed in the sealed container, each of the plurality of color elements comprising:

a cathode;

a first anode having a first end surface, a second anode having a second end surface, and a third anode having a third end surface, wherein the first anode, the second anode and the third anode are located around the cathode so that an orthographic projection of the first end surface, the second end surface, and the third end surface form a triangle;

three different-color phosphor layers, wherein each of the three different-color phosphor layers is located on one of the first end surface, the second end surface and the third end surface and has a luminescence surface opposite to the light permeable surface; and three carbon nanotube strings electrically connected to the cathode, wherein each of the three carbon nanotube strings has an emission portion corresponding to one of the three different-color phosphor layers.

14. The color field emission display as claimed in claim 13, wherein the triangle is an equilateral triangle.

15. The color field emission display as claimed in claim 14, wherein the cathode comprises a fourth end surface, and an orthographic projection of the fourth end surface is at a center of the equilateral triangle.

16. The color field emission display as claimed in claim 13, wherein the three different-color phosphor layers are a red phosphor layer, a green phosphor layer, and a blue phosphor layer.

17. The color field emission display as claimed in claim 13, wherein each of the three carbon nanotube strings extends from the cathode to one of the three different-color phosphor layers so that the emission portion is suspended above the luminescence surface and located between the luminescence surface and the light permeable surface.

18. A color field emission display comprising:

a sealed container comprising a light permeable portion;

a plurality of color elements enclosed in the sealed container, each of the plurality of color elements comprising:

a cathode spaced from the light permeable portion, wherein cathodes of different color elements are insulated;

two anodes spaced from the light permeable portion, wherein anodes of different color elements are insulated;

two phosphor layers, wherein each of the two phosphor layers is formed on one of the two anodes and spaced from the light permeable portion; and two cathode emitters each perpendicularly extending from a top end of the cathode and beyond the cathode, wherein a first portion of each cathode emitter is electrically connected to and in contact with the top end of the cathode, and a second portion of the each cathode emitter extends to and above one corresponding anode, and the each cathode emitter is parallel to the permeable portion.

19. The color field emission display as claimed in claim 18, wherein the each cathode emitter is a carbon nanotube string, an emission portion of the carbon nanotube string is suspended above one corresponding anode, the each emission portion corresponds to each phosphor layer, and at least some of carbon nanotube bundles in the carbon nanotube string are taller than adjacent carbon nanotube bundles and function as an electron emitter.

20. The pixel element as claimed in claim 18, wherein the second portion is arranged between the each phosphor layer and the light permeable portion.

* * * * *